United States Patent [19]

Yamada et al.

[11] 4,145,159

[45] Mar. 20, 1979

[54] BIT FOR ELECTRIC DRILLS

[76] Inventors: Akio Yamada, 356, Kasagi-cho, Ogaki City, Gifu-ken; Shohachi Shimizu, 1810-9, 8-chome, Hayashimachi, Ogaki City, Gifu-ken, both of Japan

[21] Appl. No.: 893,301

[22] Filed: Apr. 4, 1978

[30] Foreign Application Priority Data

Apr. 4, 1977 [JP] Japan ..... 52-38331
Jul. 1, 1977 [JP] Japan ..... 52-87852[U]

[51] Int. Cl.[2] ..... B26D 1/12; B27G 13/00

[52] U.S. Cl. ..... 407/53; 144/219; 144/240

[58] Field of Search ..... 407/53, 54; 144/219, 144/220, 240, 241, 134 R, 134 D, 231, 172

[56] References Cited

U.S. PATENT DOCUMENTS

| | | | |
|---|---|---|---|
| 271,646 | 2/1883 | Martignoni | 407/54 |
| 476,817 | 6/1892 | Pratt | 407/54 |
| 693,508 | 2/1902 | Fette | 407/54 |
| 1,063,995 | 6/1913 | Mintz | 407/54 |
| 1,316,959 | 9/1919 | Keiser | 144/219 |
| 2,202,251 | 5/1940 | Gille | 144/219 |

*Primary Examiner*—Harrison L. Hinson
*Attorney, Agent, or Firm*—Wenderoth, Lind & Ponack

[57] ABSTRACT

The present invention relates to an improved drill bit. In the present invention there are disposed opposite each other on a shank a cutting blade with no relief and a post. The post prevents a center swing and is of a small diameter equivalent to a cutting-in amount reduced.

6 Claims, 35 Drawing Figures

BIT FOR ELECTRIC DRILLS

BACKGROUND OF THE INVENTION

FIGS. 1 and 2 show the former art which is generally known and which inventors consider to be the basic philosophy for the present invention. Namely, a relief 14 is formed on a cutting blade 12 for a router bit 10 of the conventional type, and a shank 16 of the router bit 10 is attached to a radial router machine or pin router. The grooving process is performed by a high speed revolution of the shank 16. However, this system does not necessarily accomplish exact grooving work because there is a drawback in that a simple and easy grooving operation is not available due to the size of the equipment in large scale projects. Besides, if a bit were attached to an electric drill as shown in the present invention, it could never be used because of an extremely great center swing.

In addition to the foregoing figures, there are U.S. Pat. Nos. 2,905,059, 2,718,689, 1,446,342, 1,789,793, 3,344,497, 2,383,688, 3,817,305 and 3,882,912 among the prior art of which the inventors are aware, however, in these foregoing patents there is no solution indicated or described for solving the problems eliminated by the present invention.

BRIEF SUMMARY OF THE INVENTION

The first object of the present invention is to perform an exact grooving process without any center swing.

The second object of the present invention is to offer an easy grooving process under a stabilized condition without creating any excessive cutting-in due to the relief.

The third object of the present invention is to easily remove chips by providing a gap between the cutting blade and the post and, also, to provide a cutting blade which can be easily sharpened.

The fourth object of the present invention is to perform a simple routing operation by employing a hand electric drill.

Other purposes and advantages of the present invention will be easily understood from the following description and accompanying drawings in which:

DETAILED DESCRIPTION OF THE INVENTION

The present invention relates to a bit wherein a cutting blade without a so-called relief and a center-swing preventing post of a small diameter, which is reduced by the equivalent amount, of a cutting-in amount are oppositely disposed on the shank and its details are described according to a practical embodiment as shown below.

Figure 1:
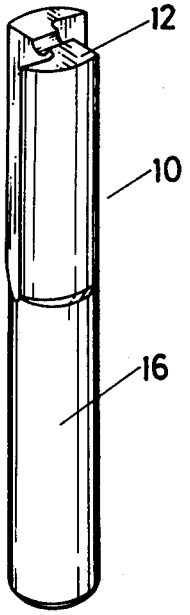
FIG. 1 is a perspective view of a conventional bit.
Figure 2:
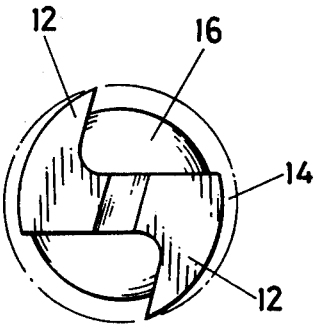
FIG. 2 is an enlarged plan view of the bit of FIG. 1.
Figure 3:
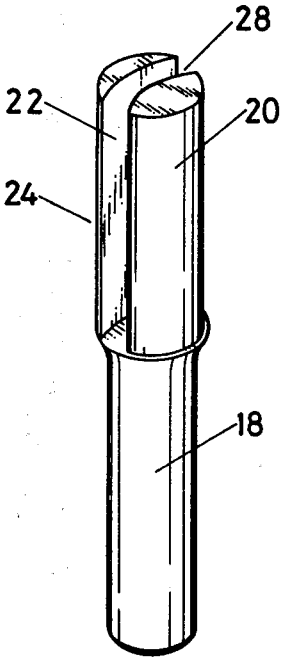
FIG. 3 is a perspective view of a first embodiment of a bit of this invention.
Figure 4:
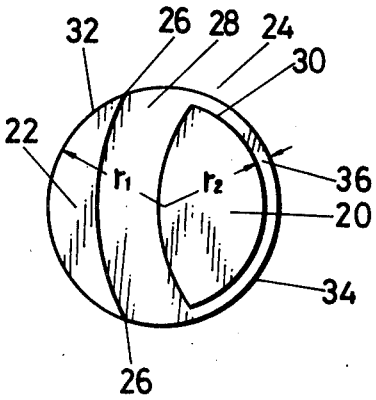
FIG. 4 is a plan view of the bit of FIG. 3.
Figure 34:
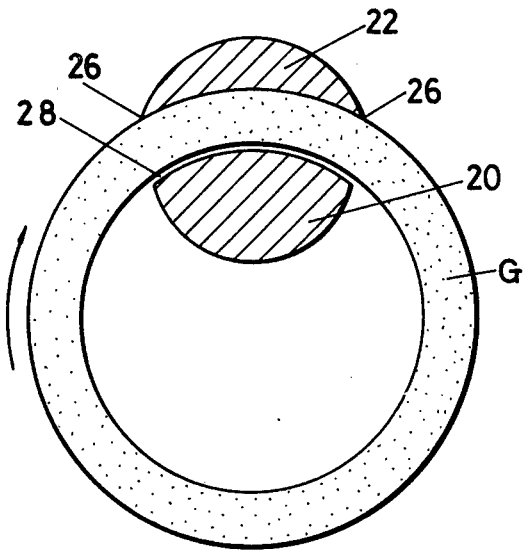
FIG. 34 and 35 are plan views showing a sharpening method for the bit.

In the first embodiment as shown in FIGS. 3 and 4, a bit 24 is created by arranging a post 20 and a cutting blade 22 on opposite sides of a shank 18. The cutting blade 22, the outer side of which is a part of a circular arc and the interior side of which is a larger circular arc than the outer circular arc, is a sectional crescent shape, and a blade edge 26 is disposed at an acute angle part of both ends of the cutting blade 22. On the other hand, the post 20 has in a sectional spindle shape, and a gap 28 is provided between the cutting blade 22 and the post 20. The post 20 and the cutting blade 22 are formed opposite each other on a concentric center. The outer circumference of the post 20 constitutes a part of a circular arc and the interior side thereof is of an circular arc shape which protrudes in the direction of the interior side of the cutting blade 22. The outer circumference of the post 20 is, as described above, a shape which is part of the circle, but the diameter thereof is such that it is slightly smaller than the diameter of the outer circumference of the cutting blade 22. A guide surface 30 of the outer circumference of the post 20 is disposed inwardly from a completed circumference 34 as much as a cutting-in amount 36 for a grooving process, and the foregoing completed circumference 34 is on the extension of an outer circumferential surface 32 of the cutting blade 22. The difference between a radius $r_1$ of the outer circumference of the cutting blade 22 and a radius $r_2$ of the post 20 is the cutting-in amount 36. The shape of the gap 28 between the cutting blade 22 and the post 20 is not necessarily specified with particularity; however, if it is formed in a circular arc shape as shown in FIG. 4, it is advantageous since it facilitates sharpening of the blade edge 26 of the cutting blade 22 as shown in FIG. 4. For example, by inserting a circular grindstone G into the foregoing gap 28 as shown in FIG. 34, the sharpening of the blade edge 26 is easily accomplished by rotating the grindstone G.

Figure 5:
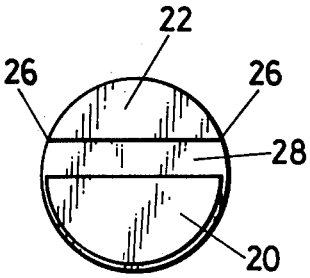
FIG. 5 is a plan view of a second embodiment.

As far as the nature of the present invention is concerned, the second embodiment is not substantially different from the first embodiment, however, as shown in FIG. 5, the gap 38 between the cutting blade 22 and the post is a straight line shape and the interior sides of the cutting blade 22 and the post 20 are respectively horizontal. There is no functional change functionally in operation of this embodiment, because the structure is the same as the first embodiment except that it is advantageous to sharpen the blade edge 26 by inserting a straight grindstone and sliding the same back and forth.

Figure 6:
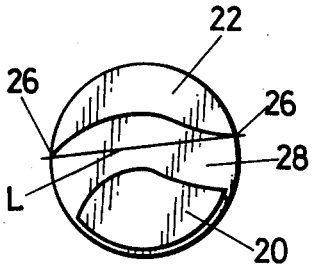
FIG. 6 is a plan view of a third embodiment.
Figure 35:
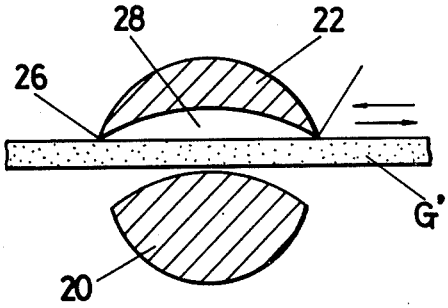

This third embodiment is shown in FIG. 6 and does not differ from the first embodiment except that there is a difference in the shape of the gap 28 between the cutting blade 22 and the post 20. The gap 28 is curved and has a wave shape, but the blade edge 26 on both ends of the cutting blade 22 is on the same line L. Therefore, the sharpening of the blade edge 26 can be, as shown in FIG. 35, performed by the straight grindstone G' similar to the second embodiment. In this embodiment the shape of the gap 28 is not particularly specified, however, it is a requisite that the blade edges 26 be on the same line L.

Figure 7:
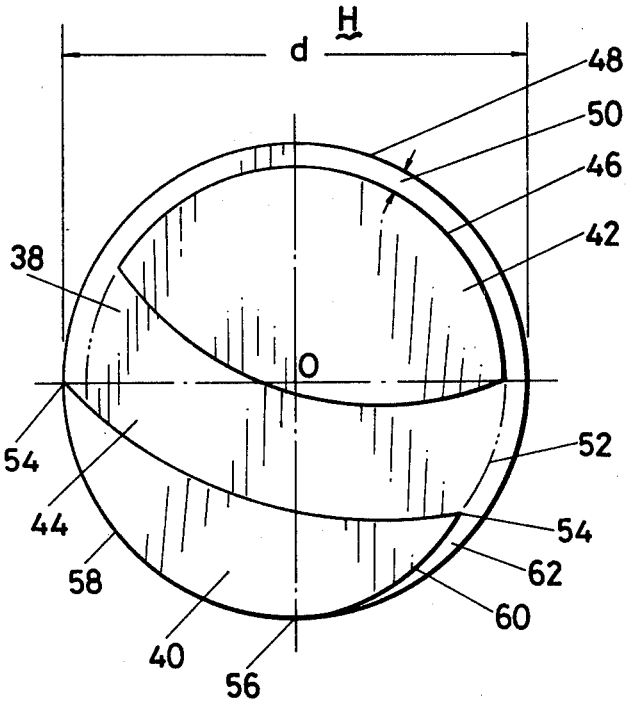
FIG. 7 is a plan view of a fourth embodiment.

The fourth embodiment pertains to an improvement of the first, second and third embodiments and is shown in FIG. 7. Namely, a cutting blade 40 having a sectional crescent shape, and a post 42, having a sectional spindle shape, are arranged on the end surface of a shank 38 with a gap 44 there in between. The cutting blade 40 and the post 42 are concentrically and oppositely formed in one unit, and the outer circumferential surface 46 of the post 42 is a circular arc which has the same diameter as the outer circumference of circle 52 which is smaller by a cutting-in amount 50 than a cutting circle 48 whose diameter is the same as a width d of a groove H of a workpiece material. As for the cutting blade 40, the outer circumferential surface 58 from one cutting edge 54 to a displace point 56 at a quarter of the circumference formed as a circular arc of the same diameter as the foregoing cutting circle 48 and an outer circumferential surface 60 from the displace point 56 to the other blade edge 54 is so formed that the angle of the circular arc becomes gradually smaller between the displace point 56 and the other cutting edge 54'. Consequently, the outer circumferential surface 60 from the displace point 56 of the cutting blade 40 to the other blade edge 54' bends gradually in the inward direction as it advances toward the other blade edge 54' from the displace point 56, and a gap 62 is formed between the cutting circle 48 and the foregoing outer circumferential surface 60.

Figure 9:
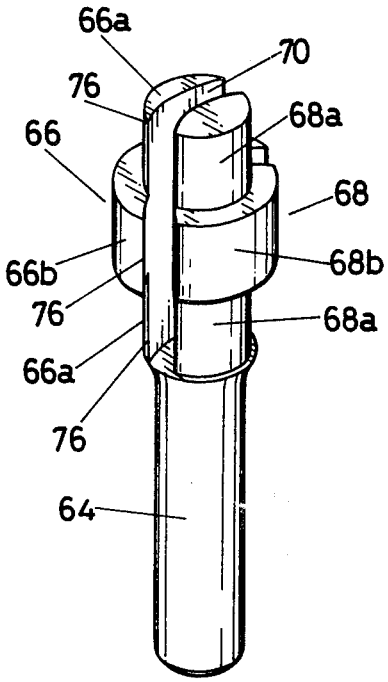
FIG. 9 is a perspective view of the fifth embodiment.
Figure 8:
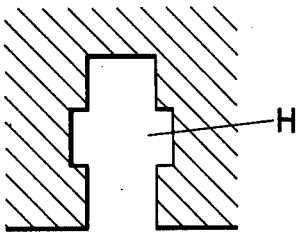
FIG. 8 is a sectional view of a groove created in a workpiece utilizing a fifth embodiment of this invention.
Figure 10:
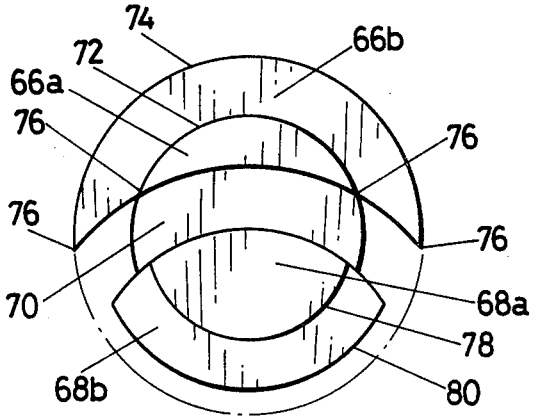
FIG. 10 is a plan view of the fifth embodiment of FIG. 9.

In the fifth embodiment, a modified groove is processed upon the workpiece, that is, in this case the groove H of a sectional cross shape is processed on the workpiece as shown in FIG. 8. A cutting blade 66 and a post 68 are, as shown in FIGS. 9 and 10, arranged concentrically and oppositely on the end of a shank 64 with a gap 70 therebetween in the same manner as described in the foregoing embodiments. However the cutting blade 66 and the post 68 protrudes at the middle section so as to correspond to the shape of the groove H to be formed. Recessed blade parts **66*a*, 66*a'* of a sectional crescent shape are provided respectively at the upper and the lower parts of the cutting blade 66, and a protruded blade part 66*b* is positioned therebetween. The outer circumferential surface 72 of the blade part 66*a* and the outer circumferential surface 74 of the blade part 66*b* differ in diameter, but are formed as circular arcs respectively and, further, a blade edge 76 is formed at the tip end of the respective blade parts. As for the post 68, there are recessed post parts 68*a*, 68*a'* which corresponds to the cutting blade 66 at the upper and the lower parts of the post and a protruded post part 68*b* which protrudes outwardly between the upper recessed post part 68*a* and the lower recessed post part 68*a'*. The outer circumferential surface 78 of the upper and the lower post parts 68*a*, 68*a'* is disposed slightly inwardly from the outer circumferential surface 72 of the blade part 66*a* of the cutting blade 66 and is smaller by an amount equivalent to the cutting-in amount which is cut off for performing the grooving process. Further, the outer circumferential surface 80 of the protruded post part 68*b* in interiorly formed with an inside arc on the outer circumferential surface 74 of the protruded blade part 66*b*** and it is smaller by an amount equivalent to the cutting-in amount. These descriptions are easily understood from the explanation for the first embodiment by making references to the accompanied drawings.

Figure 11:
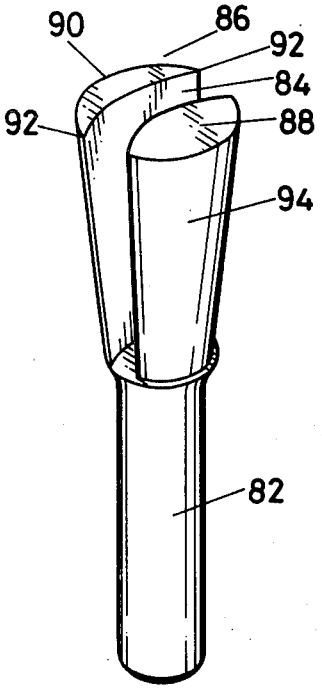
FIG. 11 is a perspective view of a sixth embodiment.
Figure 12:
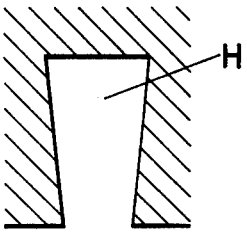
FIG. 12 is a sectional view of a groove created by the sixth embodiment of FIG. 11.

The sixth embodiment is shown in FIG. 11 and creates a groove H in the shape of a sectionally inverted frustum shape in the workpiece as shown in FIG. 12. On opposite sides of a gap 84 on the end of a shank 82 are a cutting blade 86 and a post 88 whose diameters become larger and larger toward the tip ends therof. The cutting blade 86 is of a sectional crescent shape, but it is formed so that its diameter gradually increases towards the upper end from the base of the shank 82. The outer circumferential surface 90 of the cutting blade 86 is also a circular arc. The arrangement of a blade edge 92 at the tip end of the cutting blade 86 is the same as that of the foregoing embodiments.

The sectional post 88 is of a sectional spindle type shape and is not changed from the shape of the first embodiment, however, the post is formed so that its diameter becomes gradually larger towards the upper end from its base at the shank 82. Of course, an outer circumferential surface 94 of the post 88 is disposed so that it is smaller by an amount equivalent to the cutting-in amount of the circular arc of the outer circumferential surface 90 of the cutting blade 86.

Figure 13:
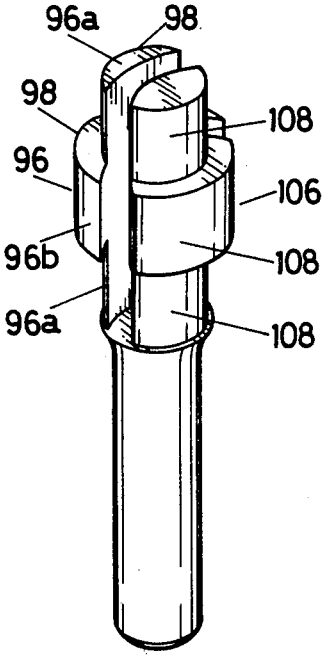
FIG. 13 is a perspective view of a seventh embodiment.
Figure 14:
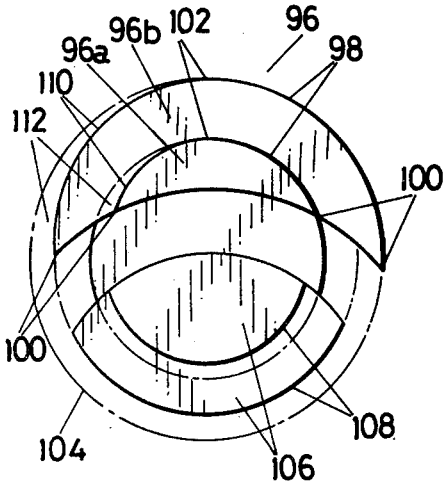
FIG. 14 is a plan view of FIG. 13.

The seventh embodiment pertains to an improvement of the fifth embodiment wherein the improvement is made in the cutting blade construction in order to more easily perform the grooving process. The fundamental construction does not at all differ from the construction shown in FIGS. 8 and 10, however, the overall contour of the outer circumferential surface 98 of the upper and the lower blade parts **96*a*, 96*a'* and the protruded blade part 96*b* therebetween which compose the cutting blade 96 is, as shown in FIGS. 13 and 14, not of a circular arc and it is understood by making references to FIGS. 7 and 14 which show the fourth embodiment that, as for the outer circumferential surface 98, the outer circumferential surface from one blade edge 100 to a displace point 102 at a quarter of the circumference is made as a circular arc of the same diameter as that of an outer cutting circle 104 and that the outer circumferential surface 110 from the displace point 102 to the other blade edge 100' is interiorly formed by making an angle of the circular arc gradually smaller with the displace point 102 connected to the other blade edge 100**.

Consequently, an outer circumferential surface 110 from the displace point 102 to the other blade edge 100' of the cutting blade 96 curves gradually in the inward direction along the curve formed from the displace point 102 to the other blade edge 100 and a gap 112 is formed between the circular arc of the cutting circle 104 and the foregoing outer circumferential surface 110.

Figure 15:
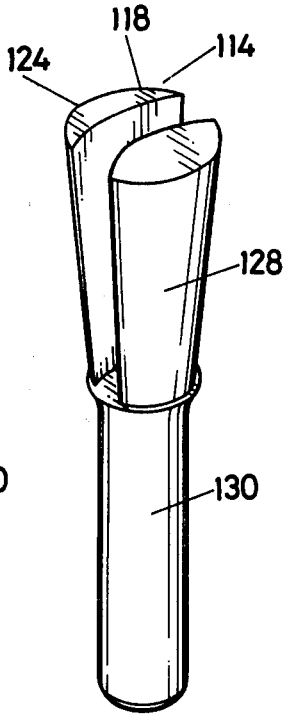
FIG. 15 is a perspective view of an eighth embodiment.
Figure 16:
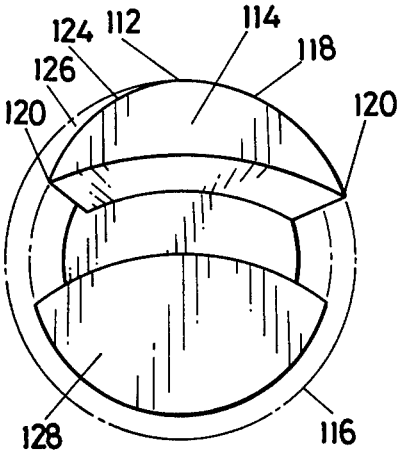
FIG. 16 is a plan view of FIG. 15.

This eighth embodiment is an improvement over the sixth embodiment and, as shown in FIGS. 15 and 16, which are the same drawings as referred to in the fourth and seventh embodiment as far as a cutting blade 114 is concerned, the outer circumferential surface 118 constitutes a part on a circular arc of a cutting circle 116 and an outer circumferential surface 124 extending from a displace point 122 at a quarter of the circumference to the other blade edge 120' curves gradually in the inward direction. Consequently, a gap 126 is formed between the outer circumferential surface 124 and the cutting circle 116. The cutting blade 114 and the post 128 are gradually formed larger in the upward direction from the base of a shank 130 respectively.

Figure 17:
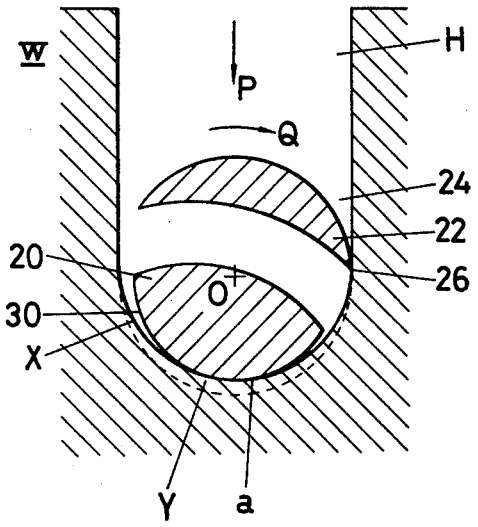
FIG. 17 to 24 are operational views showing the operation of the bit of the first embodiment.
Figure 18:
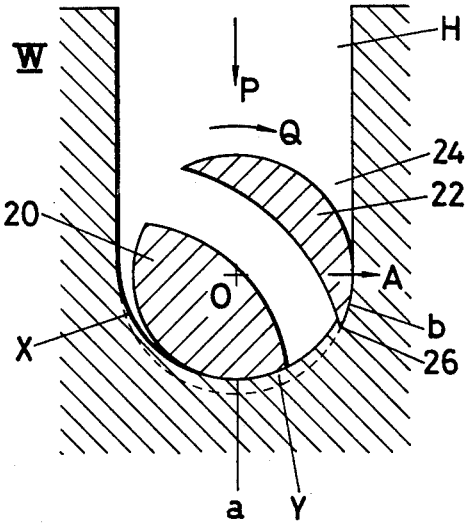
Figure 19:
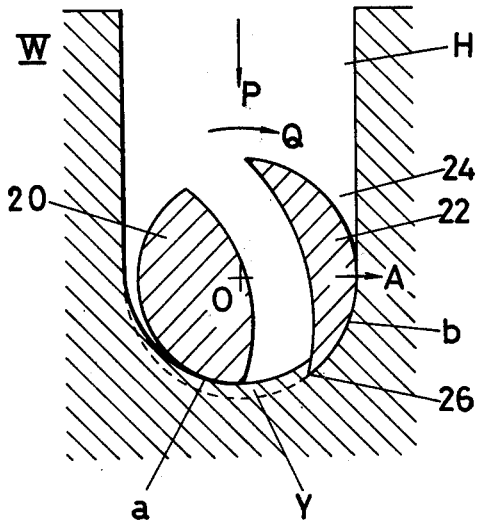
Figure 20:
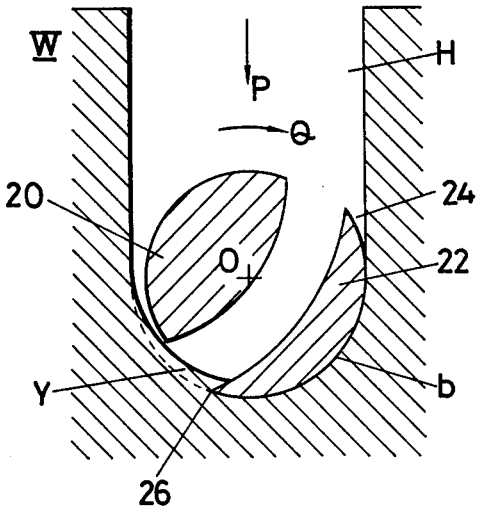

Now, operation of the present invention is described with respect to the explanatory drawing for the operation in the first embodiment. In FIG. 17, the process for making the groove H precedes in the direction of the arrow P on a workpiece material W, the bit 24 is pressed in the direction of the arrow P from a desired position at the edge of the workpiece material W as the bit 24 revolves around a shaft center O thereof in the direction of the arrow Q. When the post 20 of the bit 24 is on the advancing side (lower part in drawing), a concave surface X at the forward end of the groove H is pressed by a contacting surface a in the neighborhood of the forward end of the guide surface 30 of the post 20 and, while bit 24 is held by this concave surface X, a cutting operation commences with a cutting-in of the blade edge 26 of the cutting blade 22 into one end (right side in drawing) of an estimated cutting portion Y which is expected to be removed by a subsequent revolution. Next, following a further revolution as shown in FIGS. 18, 19 and 20, the contacting surface b on the side of the cutting blade 22 of the bit 24 grows larger as the blade edge 26 of the cutting blade 22 advances towards the forward end (bottom side in drawing), and while the contacting surface a at the forward end disappears, the bit 24 tries to move in the direction of an arrow A, but this movement is hindered by the holding of the contacting surface b; consequently, no center swing occurs.

Figure 21:
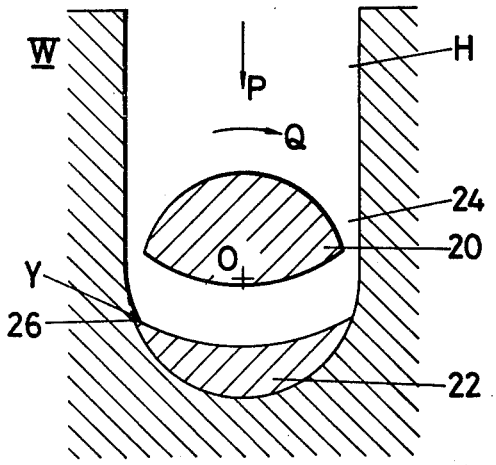
Figure 22:
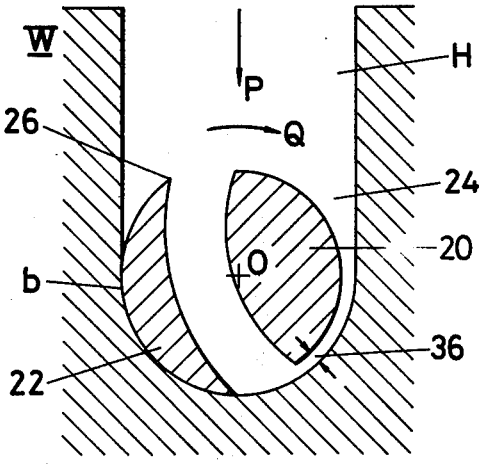
Figure 23:
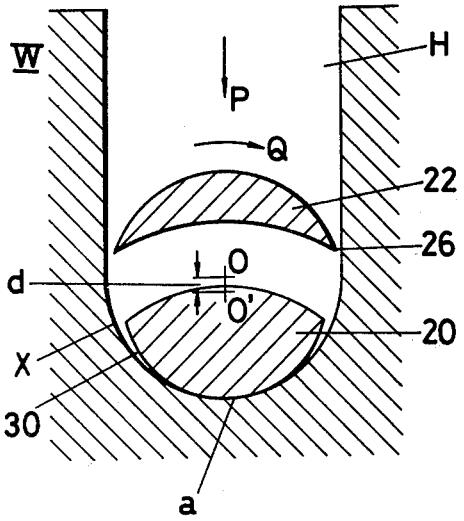
Figure 24:
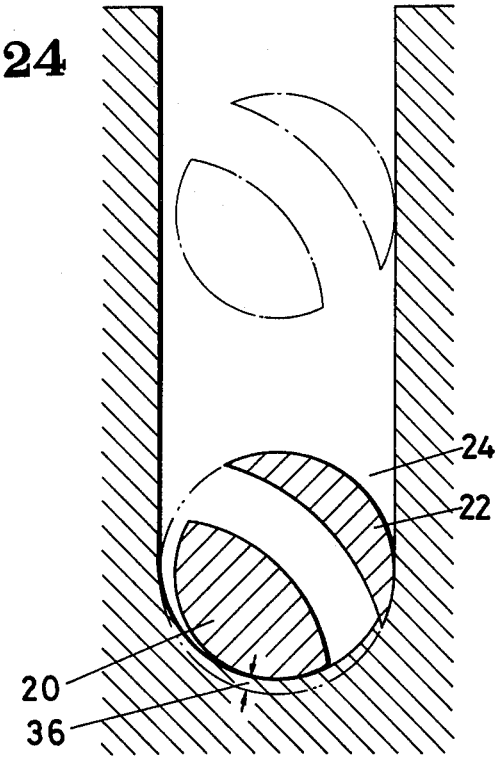

Further, in FIGS. 21 and 22, when the blade edge 26 of the cutting blade 22 cuts all the rest of the estimated cutting portion Y and enters within the groove H as a result of further revolving of the bit 24, the outer circumference of the cutting blade 22 is held by another contacting surface b (left side in drawing) opposite the previous one. The position of the shaft center O is almost unchanged during the process shown in FIGS. 17 to 22, and when the post 20 and the cutting blade 22 are, as shown in FIG. 23, positioned one above the other by a further additional revolution in the direction of the arrow P with the post 20 being directly thereunder as indicated in the drawing, the shaft center O of the bit 24 moves to the position of O' to the extent of a distance d equal to the cutting-in amount 36 as shown in FIG. 22. The forward end of the guide surface 30 of the post 24 contacts the concave surface X at the forward end of the groove H so that the foregoing cutting process can be continuously performed with less center swing and under a more stabilized condition to make the groove H. FIG. 24 shows the stabilized condition under which a grooving process is being performed by the bit 24 attached to an electric drill in the present invention.

In the present invention the operation of the second and third embodiments is entirely concave the same as that of the first embodiment because the only change is in the shape of the gap between the cutting blade and the post.

Figure 25:
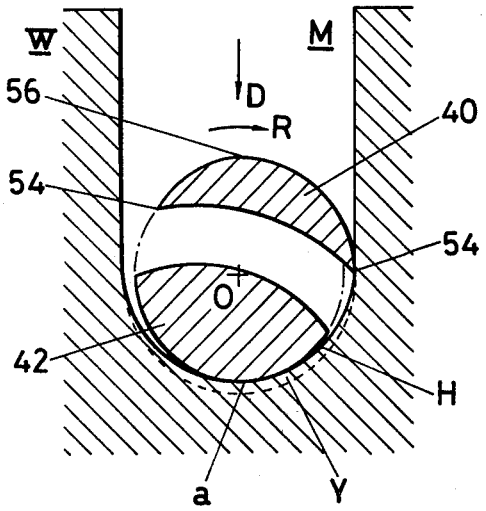
FIG. 25 to 31 are operational views showing the operation of the bit of the fourth embodiment.

In order to produce the groove M in the direction of an arrow D on the workpiece material W as shown in FIG. 25, the bit attached to the electric drill (illustration omitted) is pressed while revolving around the shaft center O of the bit in the direction of the arrow R, and when the post 42 of the bit is on the advancing side (lower side in drawing), the concave surface H at the forward end of the groove M is pressed by the contacting surface a at the forward end of the post 42. Since the bit is held by this concave surface H, the cutting operation commences with the cutting-in of the blade edge 54 of the cutting blade 40 into one end (right side in drawing) of the estimated cutting portion Y which is expected to be removed by a subsequent revolution.

Figure 26:
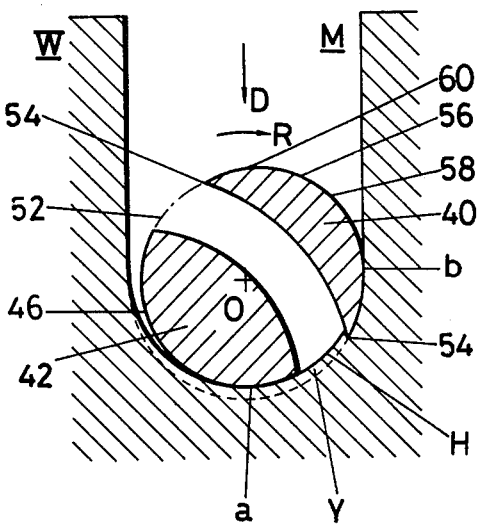
Figure 27:
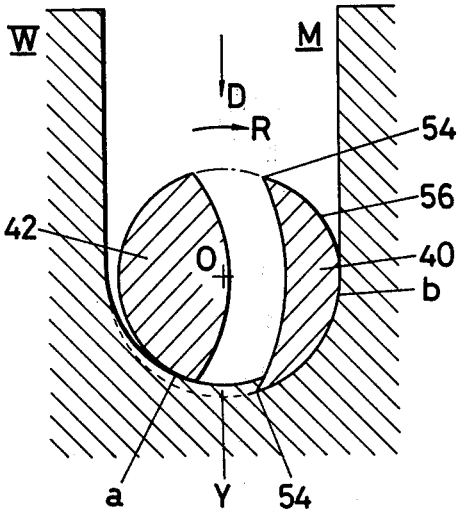
Figure 28:
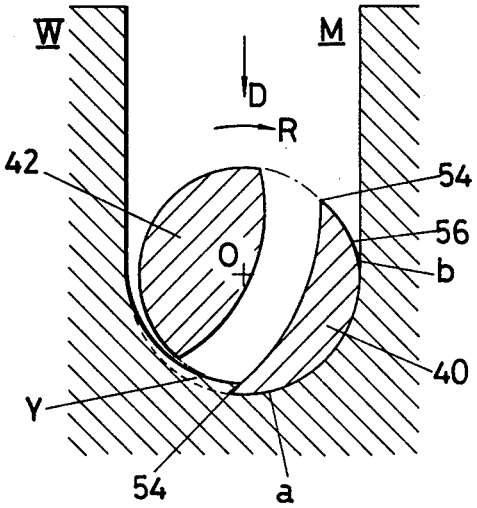

In FIGS. 26, 27 and 28, by a further revolution, the blade edge 54 of the cutting blade 40 advances towards the forward end (lower side in the drawing) of the concave surface H which is at the forward end, and in keeping with this, the contacting surface b occurs at the side of the cutting blade 40 and the contacting surface a gradually disappears at the forward end of the post 42. However, with respect to the outer circumferential surface 58 of the cutting blade 40, the rear blade edge 54 thereof is on the circumference 52 of the outer circumferential surface 46 of the post 42, and the rear blade edge 54 and the blade edge 54 form the outer circumferential surface 60 which is connected by a smooth curvature; therefore, the outer circumferential surface 58 from the blade edge 54 of the cutting blade 40 to the displace point 56 revolves with the concave surface H being contacted.

Figure 29:
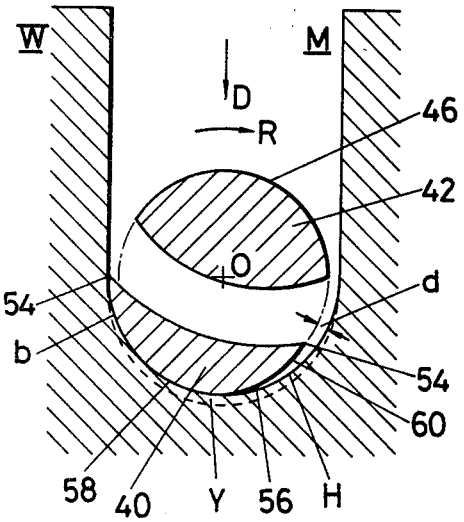

In FIG. 29, when the blade edge 54 cuts all the estimated cutting portion Y and the displace point 56 passes the foremost forward end (foremost lower side) of the concave surface H, the outer circumferential surface 60 which is at the back of the displace point 56 tries to gradually separate from the concave surface H as it advances towards the rear blade edge. However, due to a constant pushing force towards in the direction of the arrow D, the bit is always pressed against the contacting surface a at the neighborhood of the forward end of the concave surface H so that the shaft center O of the bit gradually moves in the direction of the arrow Q; that is, the bit gradually moves as much as the cutting-in amount d in the direction of the arrow Q because it is being guided by the outer circumferential surface 60.

Figure 30:
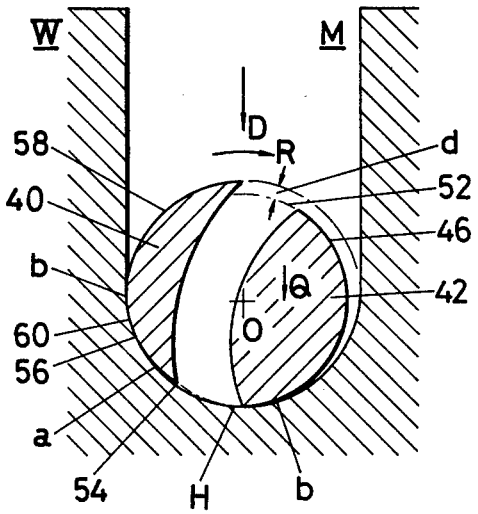
Figure 31:
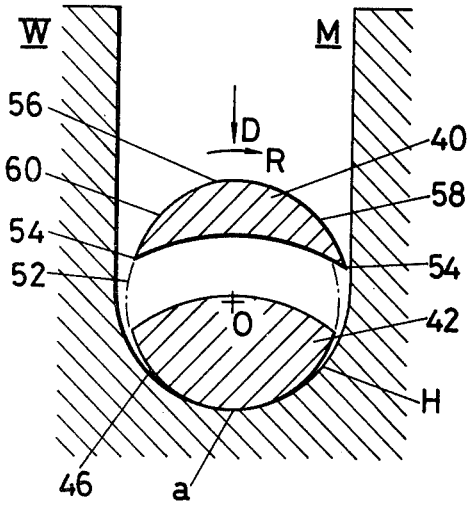

Next, in FIG. 30, when the rear blade edge 54 of the cutting blade 40 reaches the concave forward end (lower side in drawing) of the concave surface H, the bit is supported on the contacting surface a at the forward end of the concave surface H by the rear blade edge 54 of the cutting blade 40, and at the same time, the rear blade edge 54 is on the outer circumferential circle 52 of the post 42. Therefore, the outer circumferential surface 46 of the post 42 begins to make a contact with the concave surface H by the contacting surface b on the side of the concave surface H, and in FIG. 31, by a further revolution of the bit, the outer circumferential surface 46 of the post 42 supports the bit by the contacting surface a at the forward end of the concave surface H. Then, the subsequent rotational cutting process commences. Consequently, during the movement from the condition as shown in FIG. 30 to the condition as shown in FIG. 31, a smooth cut can be achieved without any appearance of vibration because there is no difference in level.

Figure 32:
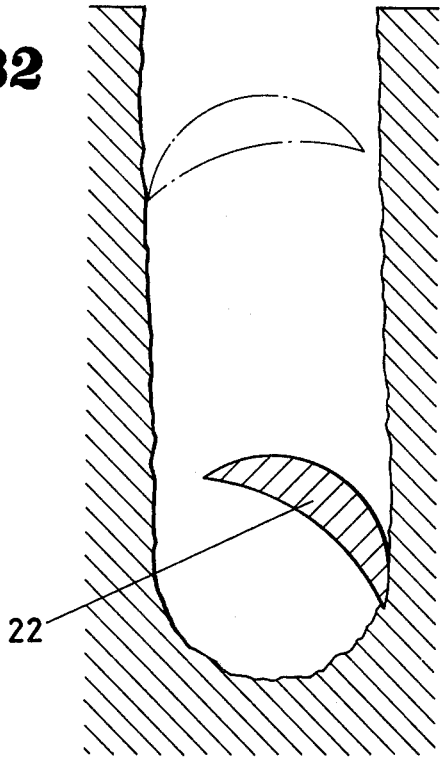
FIG. 32 is an operational view showing the operation of a bit provided with a cutting blade only.
Figure 33:
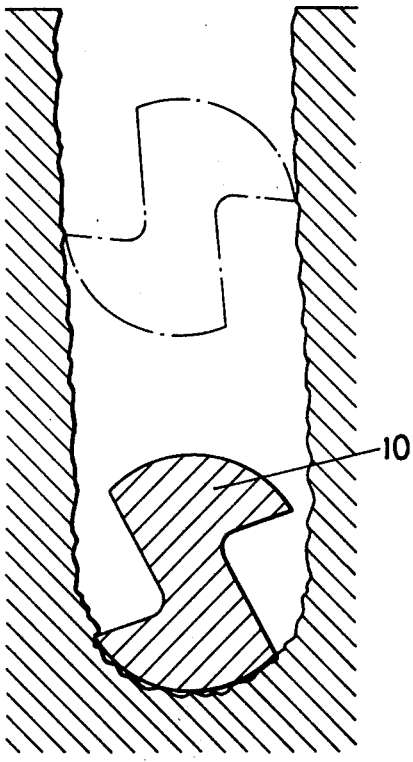
FIG. 33 is an operational view showing the operation of a conventional bit.

The operation of the fifth to the eighth embodiments is substantially the same as the operation for the first and fourth embodiments because the only change is that the cutting blade and the post are made as the front projected configuration correspondingly to the sectional configuration of the groove. It can be further said that FIG. 32 shows an instance wherein the groove cannot be formed under the stabilized condition having only the cutting blade protruded from the bit and a groove processing method performed without any post.

In FIG. 34 the blade edge 26 of the cutting blade 22 is sharpened by passing and revolving a ring-shaped grindstone G through the gap 28. And, also, in FIG. 35 the blade edge 26 of the cutting blade 22 is sharpened by passing and reciprocating left and right a plate-shaped grindstone G' through the gap 28.

Furthermore, the gap 28 not only serves as an opening for the grindstones G and G' but also assists in the removal of chips. Also, the blade edge 26 is formed symmetrically on both ends of the circular arc of the cutting blade 22 so that either a positive or a negative revolution can be performed during the cutting.

The present invention performs a grooving process for the plate material by attaching to an electric drill a bit which is formed in one unit with the shank having concentrically opposed each other a cutting blade without relief and a post with a guide face of a small radius which is reduced by an amount equivalent to the cutting-in amount, so that extremely great effectiveness can be attained as a result of the grooving process under the stabilized and easy operation coupling with the excellent cutting quality, no center swing and no excessive cutting-in for the grooving work even with a simple hand-type electric drill. Furthermore, the gap is arranged between the cutting blade and the post so that the removing of the chips can be smoothly done and the sharpening of the cutting blade is made extremely easy. Moreover there is no change in the outside diameter dimension of the bit considered for the sharpening coupling with no relief formed to the cutting blade, also, the shape of the bit can be selected freely. The manufacture thereof is easy, and the same cutting operation can be performed by either a positive or a negative revolution. Therefore, the cutting-out and grooving process for veneer boards, panels, spandrels and so forth can be done in a simplified and precise manner.

Finally the cutting blade of the sectional crescent shape and the post of the sectional spindle shape are disposed opposite each other in one unit on the end surface of the shank with the gap therebetween. The rear edge of the cutting blade coincides with the outer circumferential circle of the post and the outer circumferential surface of the cutting blade is formed by connecting the rear edge with the displace point which is at the one quarter of the circumference from the blade edge of the outer circumferential surface of the cutting blade so that when the cutting blade, which makes a contact with the concave surface at the forward end, revolves during the rotation of the bit and the post replaces the cutting blade at the contacting place, there is no difference in level and the subsequent rotational cutting takes place smoothly. Consequently, vibration occur and the grooving process is both smooth and exact.

What is claimed is:

1. A bit wherein a cutting blade without a relief and a center-swing preventing post of a small diameter which is reduced by an equivalent amount to a cutting-in amount are disposed concentrically and oppositely each other at a specified gap on a shank.

2. A bit as claimed in claim 1 wherein a shape of the gap is of a circular arc.

3. A bit as claimed in claim 1 wherein the shape of the gap is of a straight line.

4. A bit as claimed in claim 1 wherein the shape of the gap is of a wave shape and blade edges at the both ends of the cutting blade are on the same line.

5. A bit wherein the center-swing preventing post with an outer circumferential surface of a circular arc which is smaller than a cutting circle by the equivalent amount to the cutting-in amount and an outer circumferential surface extending from one blade edge to a displace point which is at a quarter of an circumference are disposed with the same diameter of a circular arc as that of the foregoing cutting circle, a cutting blade is formed by making an angle of a circular arc gradually smaller along on an outer circumferential surface which is formed by connecting the displace point and the other blade edge and the said cutting blade and the said post are concentrically and oppositely disposed each other on the shank.

6. A bit wherein the cutting blade without the relief and the center-swing preventing post of the small diameter which reduced by the equivalent amount to the cutting-in amount are disposed concentrically and oppositely on the shank with the gap therebetween and the shape of the cutting blade and the post are so disposed to correspond to a sectional shape of the groove to be formed on a workpiece.

* * * * *